US006505911B1

(12) United States Patent
Hwang

(10) Patent No.: US 6,505,911 B1
(45) Date of Patent: Jan. 14, 2003

(54) METHOD FOR MICRO INJECTING DEVICE FOR CLEANING NOZZLES

(75) Inventor: Seung-Taik Hwang, Seoul (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/572,890

(22) Filed: May 18, 2000

(51) Int. Cl.[7] ..... B41J 2/165
(52) U.S. Cl. ..... 347/23
(58) Field of Search ..... 347/23, 35

(56) References Cited

U.S. PATENT DOCUMENTS 4,558,332 A * 12/1985 Takahashi ..... 347/35 X
5,530,462 A * 6/1996 Takahashi et al. ..... 347/23

FOREIGN PATENT DOCUMENTS

JP 59-207259 A * 11/1984 ..... 347/23
JP 63-252748 A * 10/1988 ..... 347/23
JP 3-155952 A * 7/1991 ..... 347/35

* cited by examiner

*Primary Examiner*—Michael Nghiem
(74) *Attorney, Agent, or Firm*—Robert E. Bushnell, Esq.

(57) ABSTRACT

A method of controlling a micro injecting device performs spitting action which sprays ink from nozzles to maintain the clean state of the nozzles of the micro injecting device. The method includes the steps of: storing respective code values corresponding to the numbers of the nozzles that have sprayed ink among all the nozzles, in a storage section, when printing is initiated; detecting a spitting action performance time while checking the number of printed pages; checking the code values of nozzles among all the nozzles which have sprayed ink over a predetermined frequency during printing by using respective code values stored in the storage section, if it is a spitting action performance time as a result of detection; searching for computed remaining code values by computing the code values of the nozzles that have sprayed ink from reference code values which correspond to all nozzles pre-stored in the storage section; and performing spitting by spraying ink from nozzles which are determined to correspond to the remaining code values as a result of searching. Therefore, before performing spitting, by checking respective nozzles used during actual printing and comparing them to all the nozzles of the micro injecting device, and allowing spitting for only the nozzles unused during printing among all the nozzles of the micro injecting device, unnecessary consumption of ink is prevented.

9 Claims, 2 Drawing Sheets

METHOD FOR MICRO INJECTING DEVICE FOR CLEANING NOZZLES

BACKGROUND OF THE INVENTION

1. Field of the Invention

This invention relates to a nozzle cleaning method for a micro injecting device, and more particularly, to a nozzle cleaning method of a micro injecting device that prevents unnecessary consumption of ink when performing spitting by checking for used. nozzles during printing and performing spitting for only the unused nozzles.

2. Prior Art

Generally, unlike the dot matrix printer, an inkjet printer which utilizes a micro injecting device uses a cartridge and thereby is able to embody color documents and has a low noise level and elegant print quality. However, compared to a laser printer, the printing speed is more or less slower than the laser printer and the printing resolution is comparatively low. However, because the price and maintenance expenses are low in comparison to a laser printer, inkjet printers are widely used.

The micro injecting device of an inkjet printer is mounted on a cartridge and a plurality of nozzles, which spray ink, are located within the micro injecting device.

For these conventional inkjet printers, generally three methods are used to clean the nozzles of the micro injecting devices.

The first method is capping. This method prevents foreign substances from sticking onto the nozzles during print standby and power-off state by actuating a rib that is mechanically installed onto one side of the home position, when the micro injecting device is being moved to the home position, and by covering the nozzles with capping rubber.

The second method is wiping. After the micro injection device assumes the capping operation, this method moves the micro injection device at a certain distance to one side and a wiping rubber installed under the nozzle cleans the whole surface of the nozzles through the use of friction.

The third method is spitting. After the micro injecting device assumes the wiping operation, this method prevents the nozzles of the micro injecting device from clogging by spraying ink from all of the nozzles, prior to being moved to the home position. In addition, when the printed pages exceed a certain amount, the printer moves the micro injecting device to the home position and cleans the micro injecting device by performing spitting.

However, according to the conventional printer, the following problems arise.

In actual printing operations, it happens that among all the nozzles of the micro injecting device, nozzles that spray ink and nozzles that do not spray ink exist. However, although the nozzles that have sprayed ink during printing are clean because they sprayed ink, when the micro injecting device performs spitting, ink is sprayed from all nozzles and ink is needlessly consumed.

SUMMARY OF THE INVENTION

Therefore, this invention is disclosed to resolve such problems, and the object thereof is to prevent unnecessary consumption of ink by checking for nozzles actually used during printing and performing spitting for only the nozzles which were not used.

To achieve the foregoing object, the present invention is characterized in a method of controlling a micro injecting device that performs spitting action which sprays ink from nozzles to maintain the clean state of the nozzles of the micro injecting device comprising the steps of: storing respective code values corresponding to the numbers of the nozzles that have sprayed ink among all the nozzles, in a storage section, when printing is initiated; detecting a spitting action performance time while checking the number of printed pages; checking the code values of nozzles among all the nozzles which have sprayed ink over a predetermined frequency during printing by using respective code values stored in the storage section, if it is spitting action performance time as a result of detection; searching for computed remaining code values by computing the code values of the nozzles that have sprayed ink from reference code values which correspond to all nozzles pre-stored in the storage section; and performing spitting by spraying ink from the nozzles which have been determined to correspond to the remaining code values as a result of searching.

Here, when spitting is completed, the code values stored in the storage section and the remaining code values are deleted.

In addition, to detect the code values, the steps of searching for the code values, among respective code values stored in the storage section, which are stored over a predetermined number of times; and storing the searched code values in a separate sector in the storage section, are included.

In addition, to search for code values, the code values remaining after coinciding code values are deleted among the code values corresponding to all nozzle numbers are stored in another separate sector in the storage section.

On the other hand, to perform spitting, micro injecting device nozzle control signals are generated according to the remaining code values stored in the other separate sector of the storage section.

BRIEF DESCRIPTION OF THE DRAWINGS

The above objects and features of this invention will be become apparent through the detailed descriptions of the preferred embodiments and with reference to the drawings annexed hereto.

DESCRIPTION OF THE PREFERRED EMBODIMENTS

The preferred embodiment of this invention is described in detail hereinafter with reference to the annexed drawings. The same reference numbers are used for the descriptions of the same components as the prior art.

Figure 1:
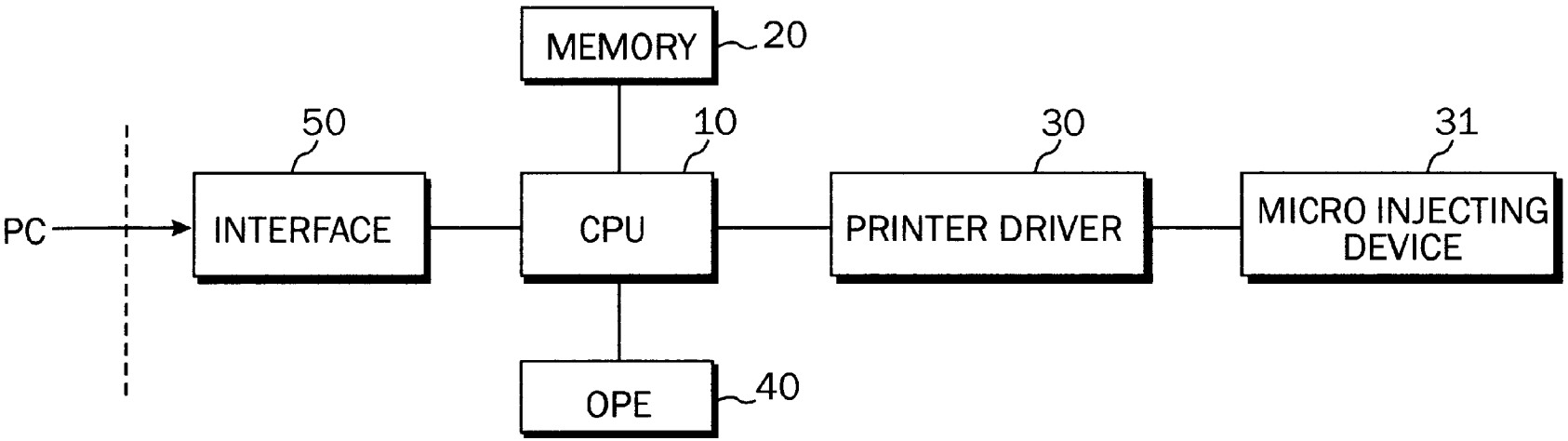
FIG. 1 is a schematic block diagram showing a printer employing the present invention.
Figure 2:
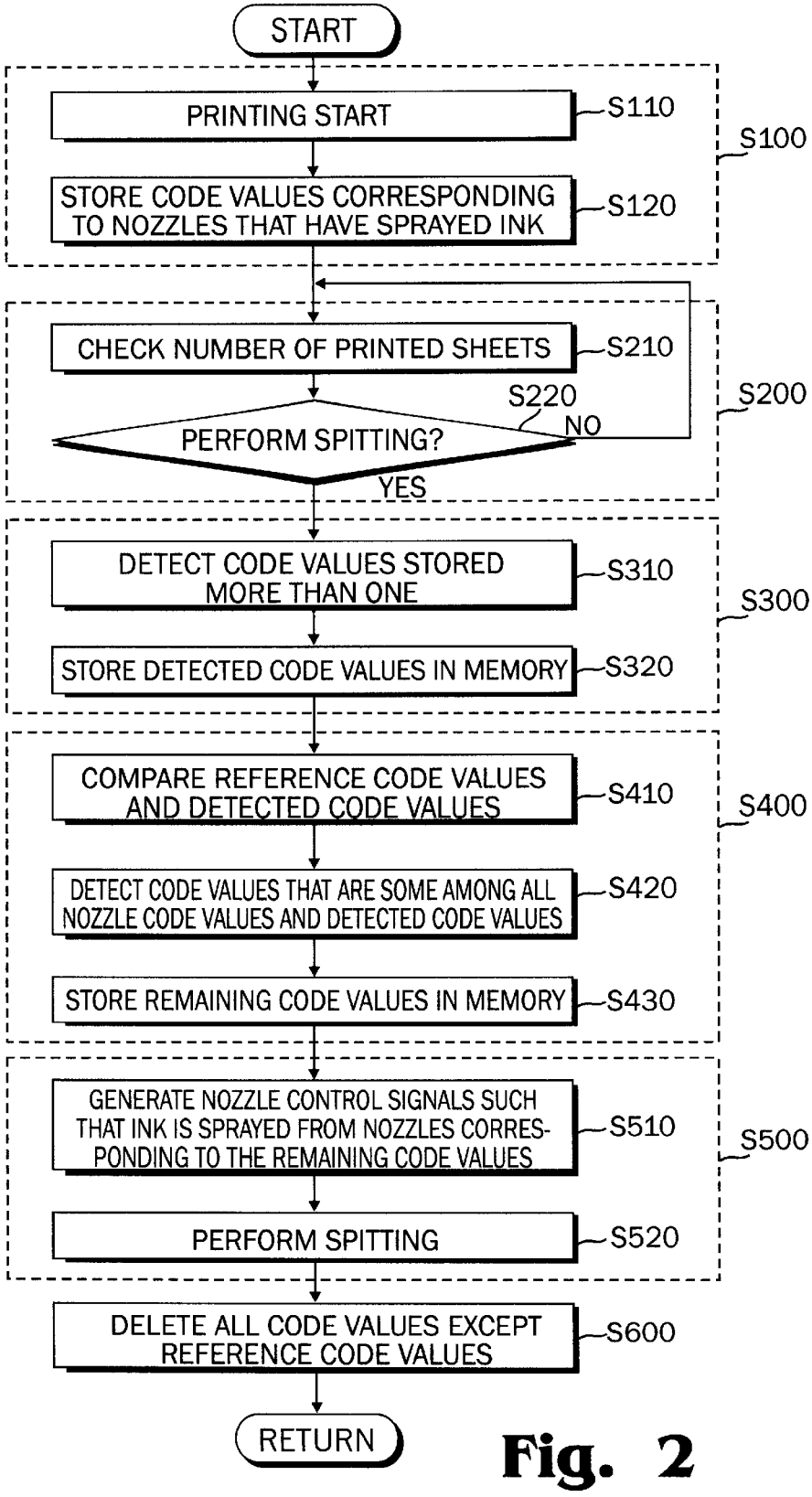
FIG. 2 is an action flow chart illustrating the micro injecting device nozzle cleaning method according to the present invention.

FIG. 1 is a schematic block diagram showing a printer employing this invention, and FIG. 2 is an action flow chart illustrating the micro injecting device nozzle cleaning method according to this invention.

As shown in FIG. 1, firstly, the central processing unit (CPU; 10) generally controls the system, and when a printer command or print data is transmitted from the computer (PC), the CPU 10 receives it through the interface 50 and interprets and converts it into image data which is the final form to be printed, and then temporarily stores it in the memory 20, and conveys the stored image data from the memory 20 to the printer driver 30, and controls the driver such that printing is performed on paper. In particular, when printing is initiated, the CPU stores in the memory 20 code values corresponding to numbers of all the nozzles (not shown) used during printing, and if it is the point in time when spitting is performed because the number of pages has exceeded a certain amount, it detects the nozzles unused during printing among all the nozzles of the micro injecting device 31 using the code values stored in the memory 20, and then controls the printer driver 30 such that ink is sprayed from only the nozzles unused during printing.

The image data is temporarily stored in the memory 20 according to the controls of the CPU 10, and programs requisite for the system are stored as well, and in particular, reference code values, which are numbers that correspond to all the nozzle values, are pre-stored, and the code values of all the nozzles used during printing-from when the power has been turned on to just before spitting is performed-is stored according to the controls of CPU 10.

The printer driver 30 controls the printing mechanism to perform printing on paper through the use of the printer. For example, the printer driver 30 controls FIRE and ENABLE of the micro injecting device 31, phase and position of the carriage return motor (not shown), and the line feed motor (not shown) which supplies printing paper and processes document data.

The operation panel (OPE;40) indicates the printer status through a display unit provided thereon, and regulates various kinds of states such as printer initialization by receiving signals from various function keys provided on the operation panel 40. The interface 50 receives document data transmitted from the PC.

The operation of the micro injecting device nozzle cleaning method according to this invention will be described hereinafter with reference to FIG. 2.

Firstly, when printing is initiated (Step S110), the CPU 10 stores respective code values corresponding to the numbers of the nozzles that have sprayed ink among all the nozzles of the micro injecting device 31 (Step S120).

At this state, the CPU 10 checks the number of pages (Step S210), and detects if it is the spitting time (Step 220), and if it is the point in time at which spitting is performed as a result of the detection, by using respective code values stored in the memory 20, the CPU 10 searches for code values that have been stored more than once among the respective code values stored in the memory 20 (Step 310).

Furthermore, the CPU 10 stores all the searched code values, that is, the code values used more than once, in a separate sector of the memory 20 (Step 320), and compares the above code values with the reference code values of all nozzles pre-stored in the memory 20 (StepS410), and deletes the code values among reference code values identical to the code values stored in the separate sector (Step S420).

In addition, the CPU 10 stores the remaining code values after the identical code values have been deleted among reference code values, in another separate sector of the memory 20 (Step S430).

In addition, with the remaining code values stored in another separate sector of the memory 20, the CPU 10 generates micro injecting device 31 nozzle control signals such that ink is sprayed from the nozzles to the remaining code values (Step S510), and send; the generated nozzle control signals to the printer driver 30, and the printer driver 30 performs spitting by spraying ink from the micro injecting device 31 nozzles (Step S520).

When the spitting is completed, the CPU 10 controls the memory 20 to delete all code values except for the pre-stored reference code values (Step S600), and if the power is on, the CPU 10 returns to step S110, and performs the procedure following S110.

In step S220, if the printed number of pages(sheets) does not exceed a predetermined number, the CPU(10) returns to step S210 and performs procedures following the step S210.

As a specific example, in a situation where the total number of nozzles in the micro injecting device is 128, and spitting is performed whenever one page of printing is completed, if the eighth through the ninetieth (8–90th) nozzles and the ninety-fifth through the one hundred and twentieth (95–120th) nozzles are the nozzles used more than once during printing, when one page of printing is completed, the CPU 10 will output signals to the printer driver 30 such that the CPU 10 will perform spitting for nozzles other than the eighth through the ninetieth (8–90th) nozzles and the ninety-fifth through one hundred and twentieth (95–120th) nozzles among the one hundred and twenty eight (128) nozzles, which will be the first to the seventh (1–7th) nozzles and the one hundred and twenty-first to the one hundred and twenty-eighth (121–128th) nozzles, and ink will be sprayed from the first to the seventh (1–7th) nozzles, the ninety-first to the ninety-fourth (91–94th) nozzles and from the one hundred and twenty-first to the one hundred and twenty-eighth (121–128th) nozzles and the ninety-first through ninety-fourth (91–94th) nozzles.

Similarly, during printing of each page, by detecting unused nozzles with the above described method, ink can be sprayed from the unused nozzles.

Therefore, when performing spitting action, the nozzles used during printing do not need to spray ink since they have sprayed ink while printing, and unnecessary ink consumption is prevented by spraying ink from only the nozzles that were unused during printing.

As discussed above, the micro injecting device nozzle cleaning method according to this invention possesses the following advantages.

Namely, before performing spitting, by checking respective nozzles used during actual printing and comparing to all the nozzles of the micro injecting device, and allowing spitting for only the nozzles unused during printing among all nozzles of the micro injecting device, unnecessary consumption of ink is prevented.

It is to be understood, however, that even though the present invention has been described with reference to the annexed drawings which depict the preferred embodiments thereof, the present invention is not limited to the said embodiments, and may apparently be modified in many ways by those ordinarily skilled in the art without departing from the general principle and scope of the invention expressed in the appended claims.

What is claimed is:

1. A method for micro injecting device for cleaning nozzles and for controlling performs spitting action which sprays ink from nozzles to maintain the clean state of the nozzles of the micro injecting device, comprising the steps of:

storing in a first storage means respective code values corresponding to the numbers of nozzles that have sprayed ink a predetermined number of times for a predetermined number of pages when printing is initiated;

storing, in a second storage means, all reference code values for said micro injecting device;

determining computed remaining code values by comparing the code values of said nozzles that have sprayed ink said predetermined number of times for said predetermined number of pages to reference code values stored in said second storage means; and performing spitting by spraying ink only from nozzles corresponding to said computed remaining code values.

2. The method of claim 1, further comprising the step of deleting stored reference code values in said second storage means after said determining step for code values found in said first storage means.

3. The method of claim 1, said determining step is preceded by the steps of:

deleting reference code values from said second storage means that are present in said first storage means; and storing, in a third storage means, code values representing nozzle numbers remaining in said second storage means.

4. The micro injecting device nozzle cleaning method of claim 1, wherein said spitting step comprises the step of generating nozzle control signals of said micro injecting device according to said remaining code values.

5. The method of claim 1, said first storage means, said second storage means and said third storage means represent different sectors of memory within a single memory.

6. A method of providing maintenance in an efficient manner to a micro injecting device, comprising the steps of:

assigning a number to identify each nozzle of said micro injecting device;

storing, in a first memory, each nozzle number for said micro injecting device;

storing, in a second memory, ones of said numbers that uniquely identify a nozzle that is used to print a predetermined number of pages and a corresponding number of times each nozzle ejects ink in a process of printing said predetermined number of pages;

printing said predetermined number of pages by said micro injecting device;

storing, in a third memory, ones of said plurality of nozzle numbers that are stored in said second memory that eject ink more than a predetermined number of times;

comparing said third memory with said first memory and removing nozzle numbers from said first memory for nozzle numbers found in said third memory; and performing a purge only on nozzles corresponding to nozzle numbers that remain in said first memory.

7. The method of claim 6, said predetermined number of times being 2.

8. The method of claim 6, said predetermined number of pages being 1.

9. The method of claim 6, said first memory, said second memory and said third memory represent different sectors within a single memory.

* * * * *